US007212100B2

(12) United States Patent
Terenna

(10) Patent No.: US 7,212,100 B2
(45) **Date of Patent: *May 1, 2007**

(54) MEDICAL PRODUCT EXPIRATION ALERTING

(75) Inventor: Barry J. Terenna, New Hope, PA (US)

(73) Assignee: Cordis Corporation, Miami Lakes, FL (US)

( * ) Notice: Subject to any disclaimer, the term of this patent is extended or adjusted under 35 U.S.C. 154(b) by 186 days.

This patent is subject to a terminal disclaimer.

(21) Appl. No.: 11/053,345

(22) Filed: Feb. 8, 2005

(65) Prior Publication Data

US 2006/0187003 A1 Aug. 24, 2006

(51) Int. Cl.
*G08B 1/00* (2006.01)

(52) U.S. Cl. ..... 340/309.16; 340/309.3; 340/309.7; 368/10

(58) Field of Classification Search ..... 340/309.16, 340/309.2, 309.3, 309.7; 368/10, 108
See application file for complete search history.

(56) References Cited

U.S. PATENT DOCUMENTS 5,411,295 A * 5/1995 Bates et al. ..... 283/81
5,652,043 A 7/1997 Nitzan
5,699,326 A * 12/1997 Haas et al. ..... 368/327
5,802,015 A * 9/1998 Rothschild et al. ..... 368/10
5,811,204 A 9/1998 Nitzan
5,862,101 A * 1/1999 Haas et al. ..... 368/327
5,866,219 A * 2/1999 McClure et al. ..... 428/40.1
5,897,522 A 4/1999 Nitzan
6,676,021 B1 1/2004 Luski et al.
6,817,192 B2 * 11/2004 Ector et al. ..... 62/125

* cited by examiner

*Primary Examiner*—Daryl C Pope
(74) *Attorney, Agent, or Firm*—Louis J. Capezzuto

(57) ABSTRACT

A system for monitoring a time sensitive medical product includes a medical product; a packaging containing the medical product; and at least one label associated with the packaging or the medical product. The at least one label includes at least one permanent region having permanent indicia; at least one transformable region having time sensitive indicia wherein the time sensitive indicia is non-detectable in a first state and detectable in a second state; a micro-controller operatively connected to at least one of the at least one permanent region and the at least one transformable region, wherein the micro-controller monitors elapsed time and causes the at least one transformable region to change from the first state to the second state thereby revealing the time sensitive indicia in the second state; and a power source operatively connected to the micro-controller. A clock and a keypad for inputting data relating to an expiration date for the medical product are operatively connected to the micro-controller respectively.

28 Claims, 17 Drawing Sheets

MEDICAL PRODUCT EXPIRATION ALERTING

FIELD AND BACKGROUND OF THE INVENTION

The present invention relates, in general, to packaging, labeling and inventory management of medical products, and, in particular, relates to a new and useful medical product label used as an alert device, medical product packaging for a medical product using a label as an alert device, an expiration alert system and method for controlling medical product inventory based on expiration dates therefor.

It is well known that the packaging and labeling of medical products such as pharmaceuticals and medical devices are critical functions. As a result, many groups have great interest in this area besides the medical products companies and their customers and patients. For instance, groups such as the Healthcare Compliance Packaging Council (HCPC), the National Quality Forum (NQF) and others recognize the role that packaging plays in safeguarding healthcare. And of course, various government agencies, most notably the Federal Food and Drug Administration (FDA) have very stringent packaging regulations and enforcement.

Based on the critical nature and role that medical product packaging plays, there are a number of very important issues facing medical packagers as well as patients and consumers. One of these very real issues is the traceability of medical products.

Accordingly, there are considerable steps that are required to be taken to ensure packaging traceability. At this point, for example, only some manufacturers have affixed unit-of-use barcodes to hospital injectable drugs and/or IV solutions. Additionally, fraudulent products and drug counterfeiting are problems that also must be addressed. Internet drug sales contribute to this issue. The World Health Organization estimates that fraudulent drugs generate $32 billion dollars in annual earnings for drug counterfeiters. Thus, as can be imagined, tracking the pharmaceutical pedigree of these drug products continues to gain in importance.

There are also a number of other key concerns for medical product manufacturers and their customers and patients. Medical products sold and falsely represented as being "fresh", "current" or "unexpired" after their expiration dates is one of these problems.

The diversion of products and ability to keep track of key locations in the supply chain of the medical products is also a chief concern. There are also other pure business concerns relating to the ability to properly track medical products. For example, supply chain management for the ability to properly track inventories, ensure proper supplies, and improve inventory management; inventory control as a key part of supply chain management to ensure tracking of inventory throughout the cycle; the ability to properly and efficiently handle medical product recalls which is a benefit not only to the public and manufacturer but to also to the government as well. As most in the field will agree, effective and efficient traceability of manufactured medical products will ease this complex process.

In an effort to meet the growing problem of medical product traceability, packaging technology has been changing in an effort to try to meet the needs of pharmaceutical and medical device manufacturers.

The use of bar codes on medical products has been one technology used to combat the traceability problem. Bar coding is currently the methodology for tracking unit dose packaging in pharmaceuticals. However, there are issues associated with using bar codes such as bar coding requires "line of sight" to be workable. It also requires multiple scans to track a drug or medical device from the manufacturer to the patient. Bar coding can even require multiple scans within a given facility to track progress to the patient bedside. The problems with wrinkled or damaged bar code labels can also make scanning difficult.

Additionally, in the United States, the lack of unit dose packaging of prescription drugs from the manufacturer results in bulk shipments with a much higher opportunity for diversion or misuse or counterfeiting. The implementation of unit dose with bar coding is one step that has been taken toward trying to improve traceability.

Other known issues relate to products containing components that are subject to degradation or are otherwise unsuitable for use after a set period of time. Accordingly, it is customary that these products contain an expiration date on the product packaging.

However, this information is usually contained in small print that is not readily obvious to the consumer, distributor or other owners or holders of the products. In addition the consumer and/or distributor are not alerted when product expiration is imminent. Proper product expiration alerting would be useful to have so that consumers and/or distributors may rotate products on shelving, return expired goods to manufacturers, discount the products prior to expiration or otherwise consume the products so that an adverse event relating to the patient, economics or other event can be avoided.

Additionally, those users or patients who are sight impaired or blind are significantly disadvantaged by printed expiration dating on the product packaging.

Accordingly, to date there has been no system, device or method for alerting a user as to the expiration of a medical product or for controlling medical product inventory and traceability based on expiration dates therefor.

SUMMARY OF THE INVENTION

The present invention is directed to a new and useful medical product label (used as an alert device), package, expiration alert system and method for controlling medical product inventory based on expiration dates therefor.

In one embodiment according to the present invention, the present invention is a system for monitoring a time sensitive medical product, the system comprising:

a medical product;

a packaging containing the medical product;

at least one label associated with the packaging or the medical product, the at least one label comprising:

(i) at least one permanent region having permanent indicia;

(ii) at least one transformable region having time sensitive indicia, the time sensitive indicia being non-detectable in a first state and detectable in a second state;

(iii) a micro-controller operatively connected to at least one of the at least one permanent region and the at least one transformable region, the micro-controller monitoring elapsed time and causing the at least one transformable region to change from the first state to the second state thereby revealing the time sensitive indicia in the second state; and (iv) a power source operatively connected to the micro-controller.

The system according to the present invention has at least one transformable region that is irreversibly transformable. Additionally, the system further comprises a clock and a keypad operatively connected to the micro-controller. The keypad is optional and is used for inputting data to the micro-controller. In many examples, the data relates to an expiration date for the medical product wherein the expiration date is displayed in the at least one permanent region of the label.

The system also comprises an audio output device operatively connected to the micro-controller wherein the audio output device provides, emanates or outputs an audio signal when the at least one transformable region changes from the first state to the second state.

In certain embodiments according the present invention, the system further comprises a second transformable region operatively connected to the micro-controller. In these embodiments, the second transformable region can be used as a positive control relating to use of the medical product. Additionally, the system may further comprise a third transformable region operatively connected to the micro-controller wherein the third transformable region is used as a negative control relating to use of the medical product. Likewise, the second transformable region and the third transformable region can also display indicia. The indicia can include any combination of letters, characters, symbols, colors, etc.

In some embodiments according the present invention, the at least one transformable region, the second transformable region and the third transformable region comprise an electro-chromic material. In other embodiments, the at least one transformable region, the second transformable region and the third transformable region comprise a photo-chromic material or a thermo-chromic material respectively or any combination of these materials.

In accordance with the present invention, the medical product can be any type of health care related product, for instance, a drug, device or consumer product as specific examples, and especially any type of medical product that is time sensitive, i.e. has a limited shelf life. In preferred embodiments, the medical product is a drug eluting stent wherein the medical product further includes a stent delivery system.

Additionally, the packaging for the medical product can be in any desired form such as a bottle, box or pouch as just a few specific examples and in certain embodiments the packaging is in multiple sections, in one preferred embodiment, and comprises a box, an outer pouch, an inner pouch and a tray for the medical product.

More than one label or alert device in accordance with the present invention can be used for the medical product and/or its packaging. For example, a second label is included with the outer pouch and a third label is included with the inner pouch.

The present invention is also directed to a method for controlling inventory of a time sensitive medical product wherein the method comprising the steps of:

providing packaging for the medical product;

configuring an expiration date for the medical product;

displaying the expiration date with the medical product in a visible manner on or within the packaging or on or within the medical product;

configuring a warning period for warning of an upcoming expiration for the medical product in advance of the expiration date;

monitoring elapsed time with the packaging or with the medical product after setting the expiration date for the medical product;

displaying a warning indicator on or within the packaging or on or within the medical product of the upcoming expiration for the medical product upon commencement of the warning period.

The method further comprises providing an audio signal from the packaging or from the medical product upon reaching the configured warning period. The audio signal is provided prior to expiration date for the medical product and/or on the expiration date for the medical product. Additionally, the method further comprises using a label (as an alert device) with the packaging or the medical product for controlling inventory of the medical product.

The label is used to set the expiration date and the warning period. The label is also used to display the expiration date and the warning indicator. Moreover, using the label, elapsed time is monitored after setting the expiration date. Upon reaching the expiration date, the label provides an audio signal signaling the upcoming expiration of the medical product and/or the actual expiration of the medical product.

The method further comprises using an irreversible transformable region on the label to display the warning indicator. Additionally, the method further comprises displaying the warning indicator in discrete sections in the irreversible transformable region wherein each discrete section of the warning indicator is displayed on each day of the warning period. Accordingly, the warning indicator can be displayed in discrete sections on respective sub-regions of the irreversible transformable region.

In certain embodiments, the warning indicator uses the word EXPIRED or a variant thereof as the warning indicator. And, in these embodiments, each character of the warning indicator is displayed on a corresponding sub-region of the irreversible transformable region on respective days of the warning period.

In some embodiments, a drug is the time sensitive medical product. In other embodiments, a device is used as the time sensitive medical product. In still other embodiments, the time sensitive medical product is a drug eluting stent, either alone or with a stent delivery system.

Another embodiment of the present invention is also directed to a method for controlling inventory of a time sensitive medical product, the method comprising the steps of:

providing a medical product;

providing a packaging containing the medical product;

providing at least one label associated with the packaging or the medical product, the at least one label comprising:

(i) at least one permanent region having permanent indicia;

(ii) at least one transformable region having time sensitive indicia, the time sensitive indicia being non-detectable in a first state and detectable in a second state;

(iii) a micro-controller operatively connected to at least one of the at least one permanent region and the at least one transformable region, the micro-controller monitoring elapsed time and causing the at least one transformable region to change from the first state to the second state thereby revealing the time sensitive indicia in the second state; and (iv) a power source operatively connected to the micro-controller.

configuring an expiration date for the medical product and storing the expiration date in the micro-controller;

displaying the expiration date for the medical product in a visible manner on the label;

configuring a warning period in the micro-controller for warning of an upcoming expiration for the medical product in advance of the expiration date;

monitoring elapsed time with the micro-controller after setting the expiration date for the medical product;

displaying a warning indicator on the label of the upcoming expiration for the medical product upon commencement of the warning period.

The method further comprises providing an audio signal from the label upon reaching the configured warning period. The audio signal is provided prior to expiration date for the medical product and/or on expiration date for the medical product. The method also further comprises using an irreversible transformable region on the label to display the warning indicator.

Additionally, in certain embodiments, the method further comprises displaying the warning indicator in discrete sections in the irreversible transformable region wherein each discrete section of the warning indicator is displayed on each day of the warning period. Moreover, the method further comprises displaying the warning indicator in discrete sections on respective sub-regions of the irreversible transformable region.

As previously indicated, the word EXPIRED or a variant thereof can be used as the warning indicator. Additionally, each character of the warning indicator can be displayed on a corresponding sub-region of the irreversible transformable region on respective days of the warning period.

Moreover, in certain embodiments, a drug is used as the time sensitive medical product. In other embodiments, a device is used as the time sensitive medical product. In preferred embodiments, a drug eluting stent is used as the time sensitive medical product. And in other preferred embodiments, a stent delivery system together with the drug eluting stent is used as the time sensitive medical product.

BRIEF DESCRIPTION OF THE DRAWINGS

The novel features of the invention are set forth with particularity in the appended claims. The invention itself, however, both as to organization and methods of operation, together with further objects and advantages thereof, may be understood by reference to the following description, taken in conjunction with the accompanying drawings in which:

DESCRIPTION OF THE PREFERRED EMBODIMENTS

Figure 1A:
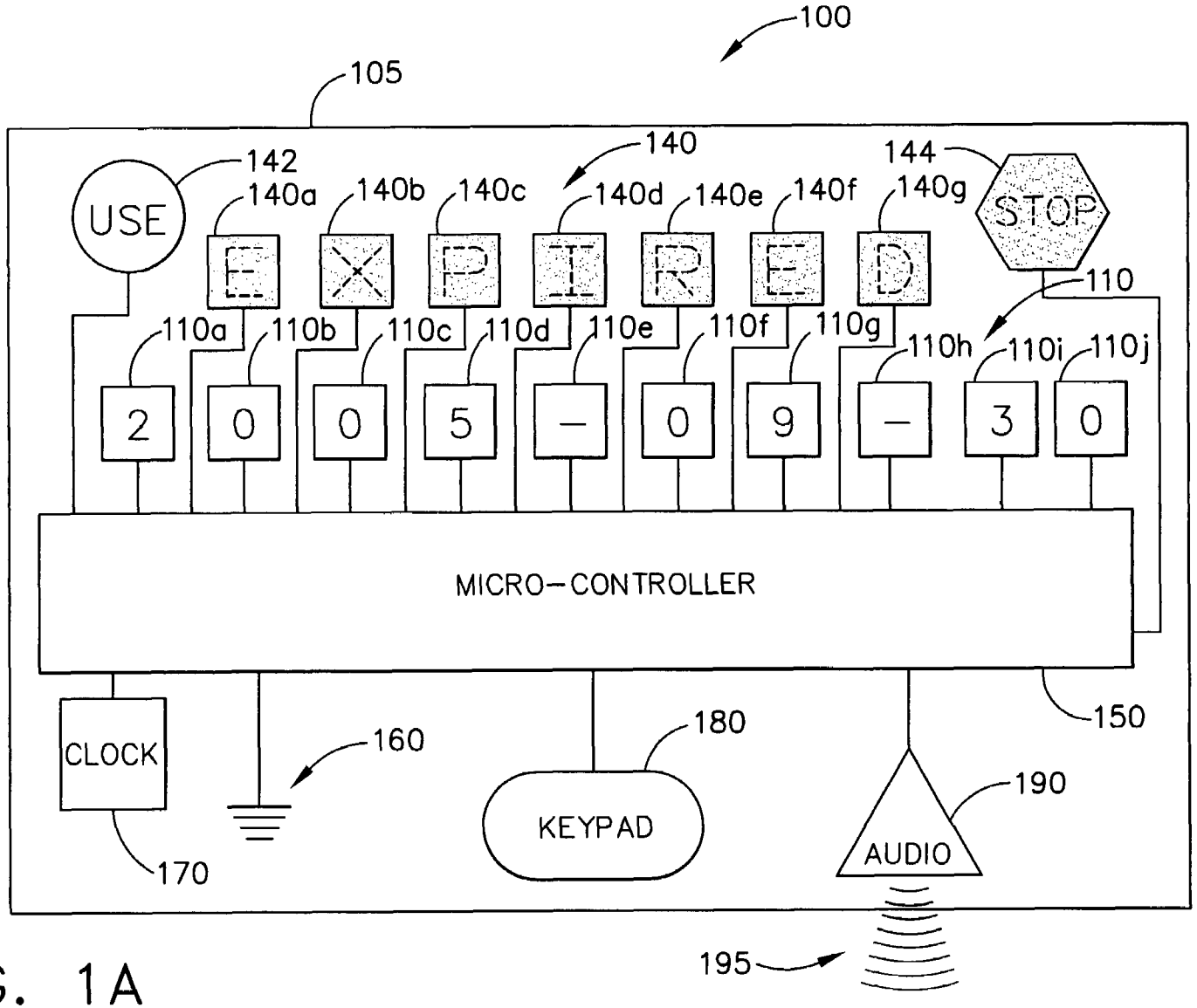
FIGS. 1A–1H illustrate a label for a medical product including a system and method for inventory control of the medical product.
Figure 1B:
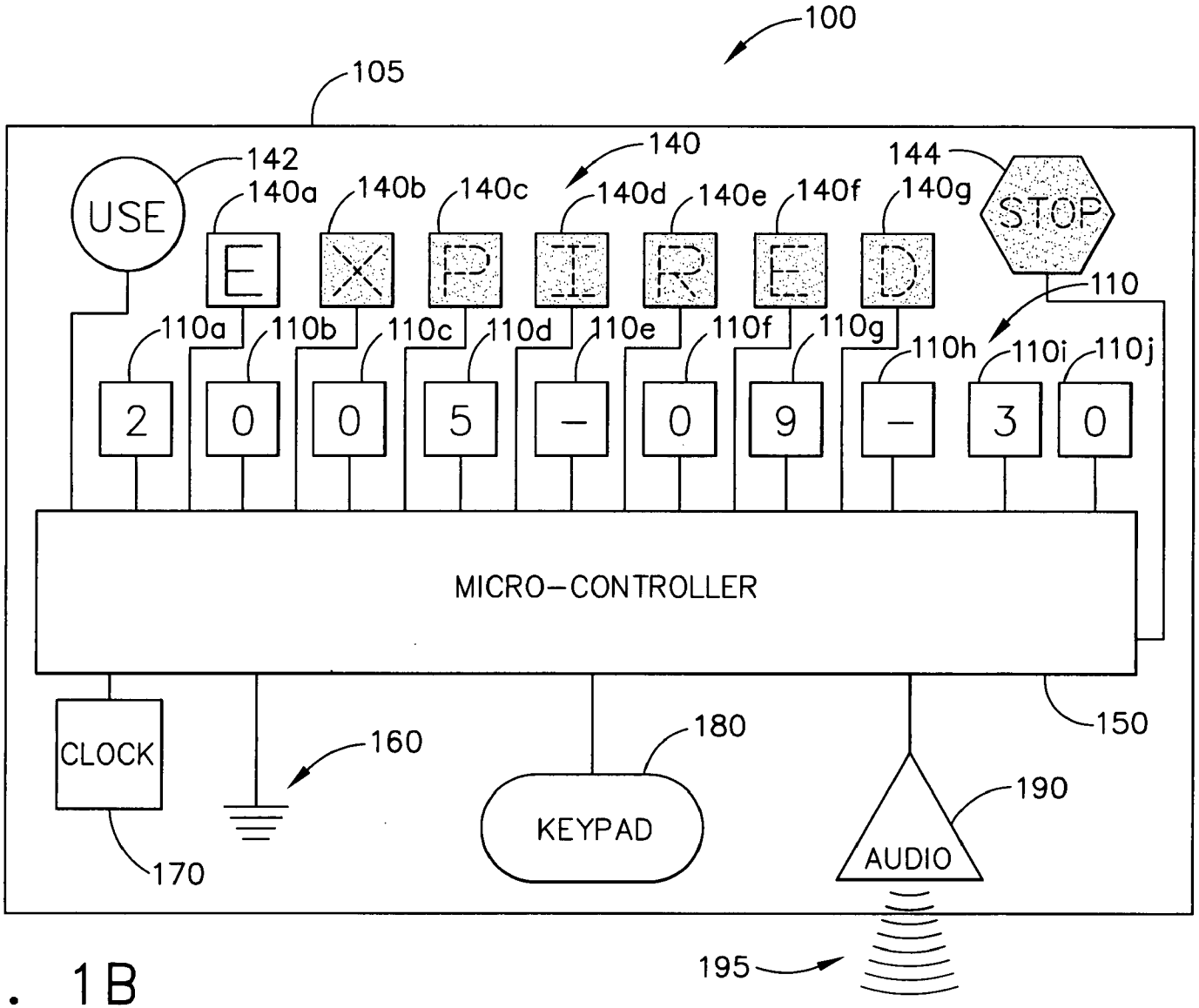
Figure 1C:
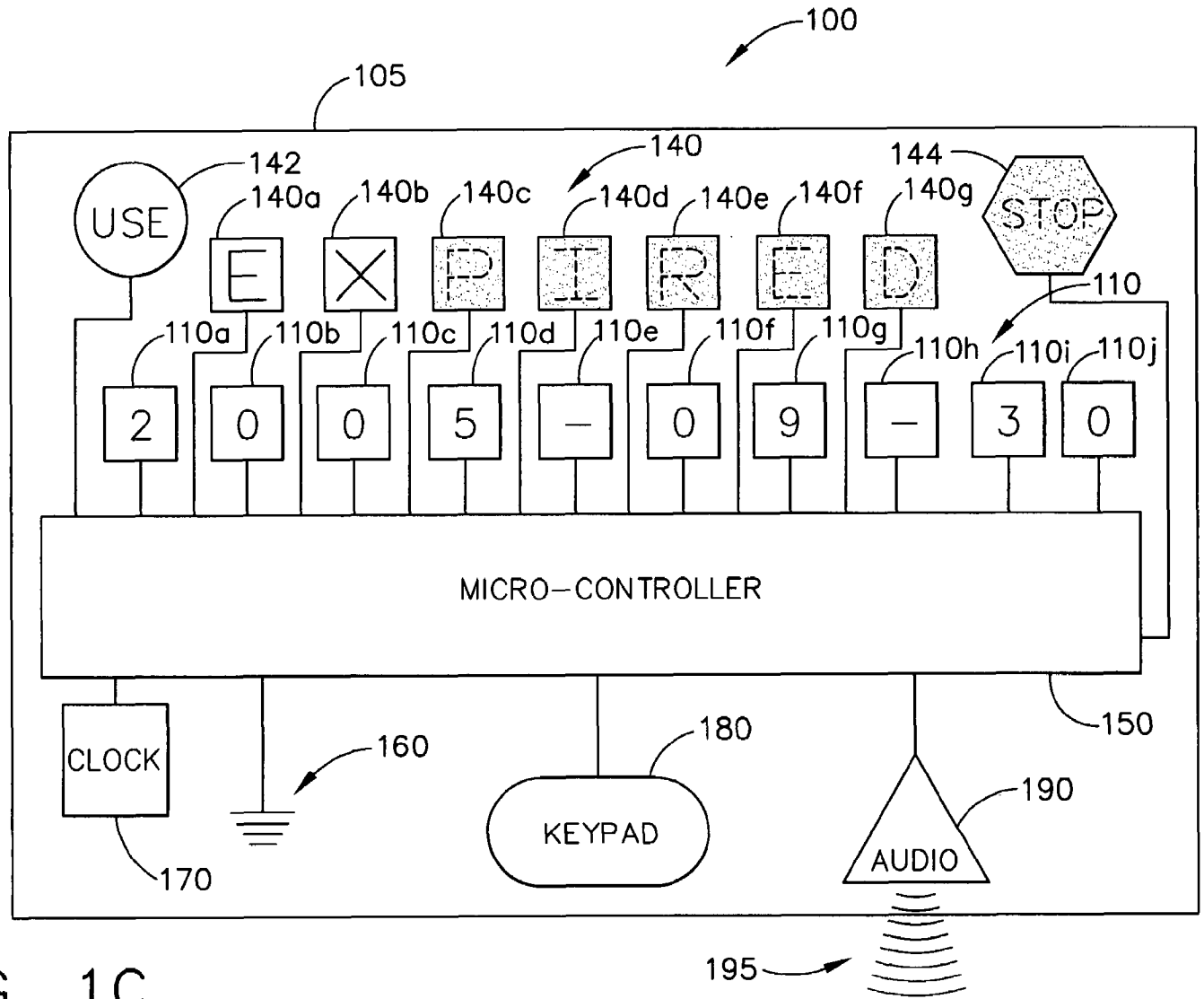
Figure 1D:
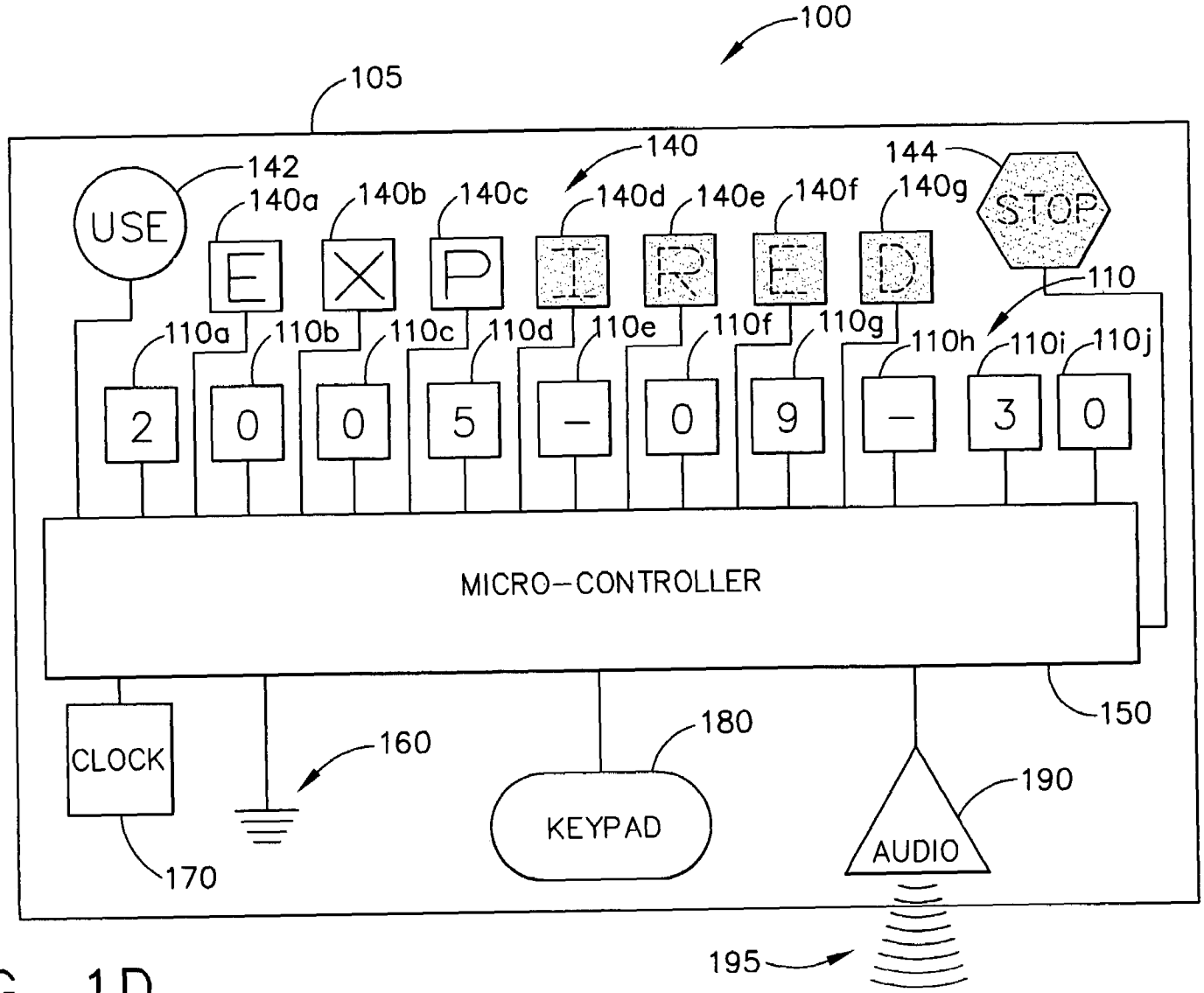
Figure 1E:
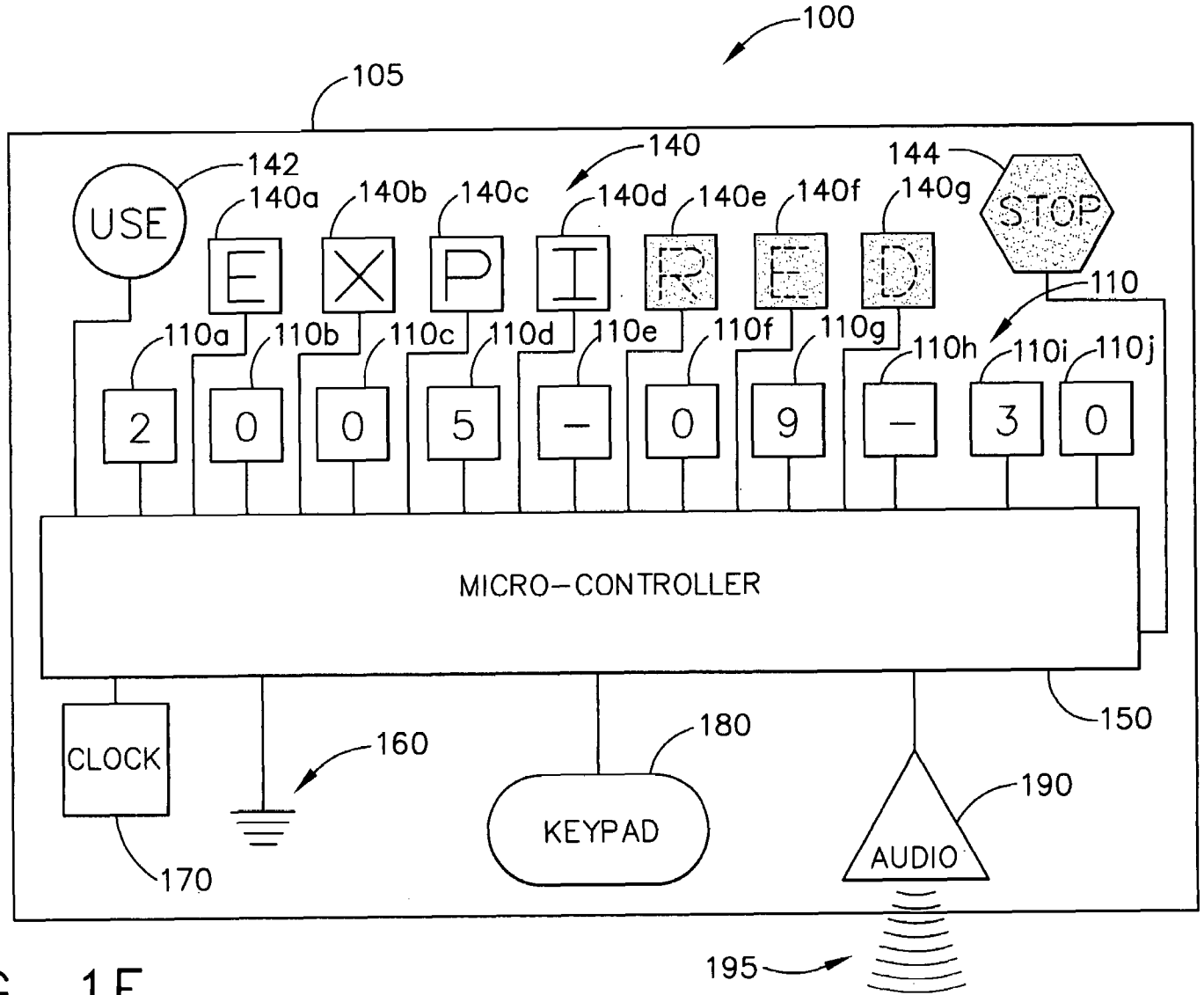
Figure 1F:
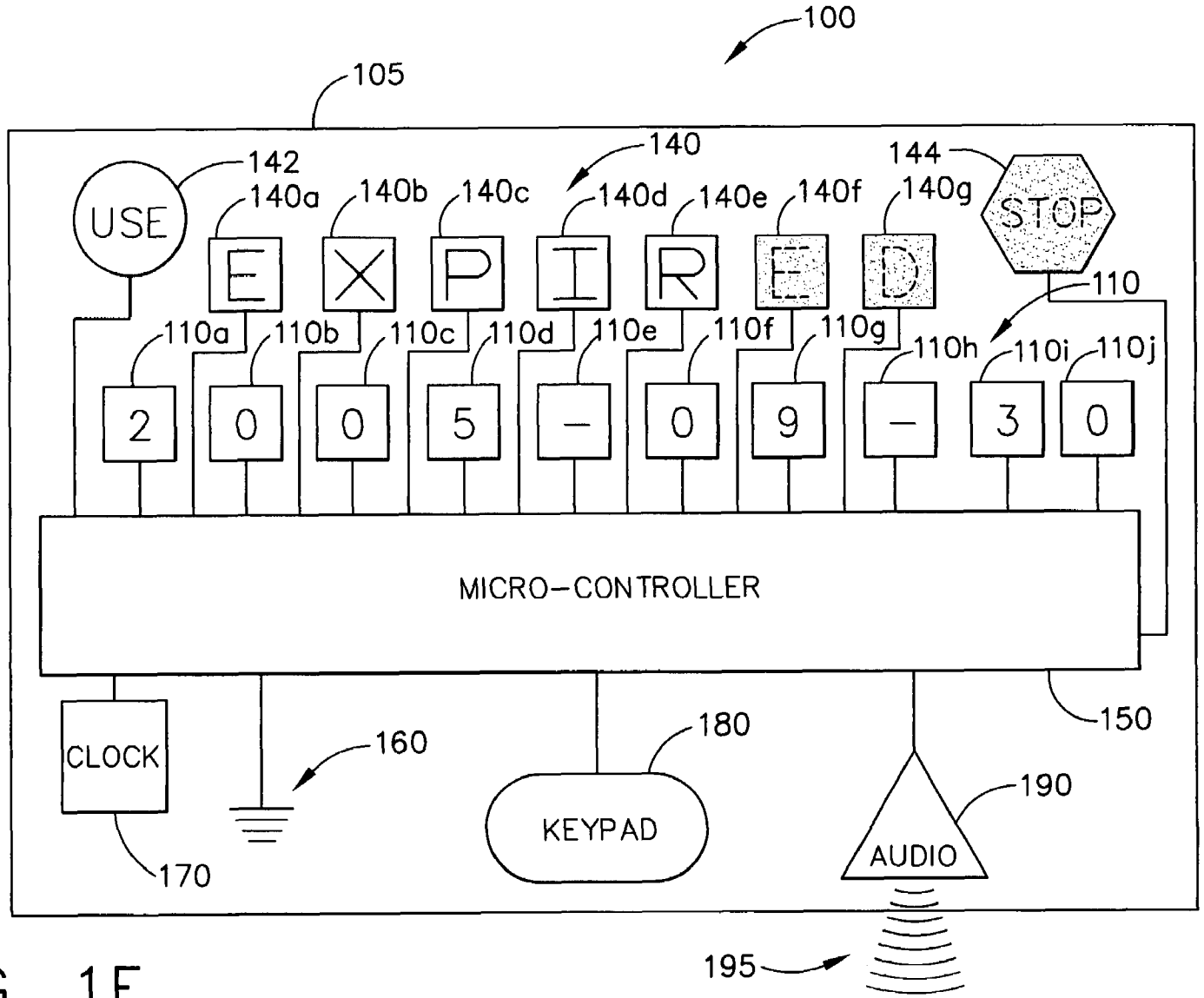

The present invention is directed to a new and useful medical product label, package, expiration alert system and method for controlling medical product inventory based on expiration dates therefor.

The principles and operation of the medical product label, package, expiration alert system and method for controlling medical product inventory according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

As best illustrated in FIGS. 1A–1H, the present invention is an alert device depicted as a label, generally designated 100, particularly useful for medical products (FIGS. 2A–2C, 3A–3C and 4A–4C), and particularly useful for time sensitive medical products, i.e. medical products that require an expiration date or have a finite shelf life after being manufactured. As defined herein, the term "medical product" means one or more drugs, pharmaceuticals, chemical compounds, biological agents, biological molecules, organisms, organs, tissue, cells or components thereof such as nucleic acids (i.e. RNA and DNA), proteins, peptides, amino acids, medical devices and their components, nutrition items such as food products, consumable items, consumer products, polymers (i.e. either natural or synthetic polymers) to include biodegradable and/or bioabsorbable polymers to include hydrogel polymers, any product useful for any therapeutic, diagnostic or healthful purpose or any product requiring an expiration date or specified period of use.

The present invention disclosed herein is directed to providing a visual and/or audible alert or signal contained as part of the packaging for the medical product or part of the medical product itself in order to notify the handlers and end users of the medial products that the medical product is nearing the end of its life cycle, period of use or expiry date.

Figure 2A:
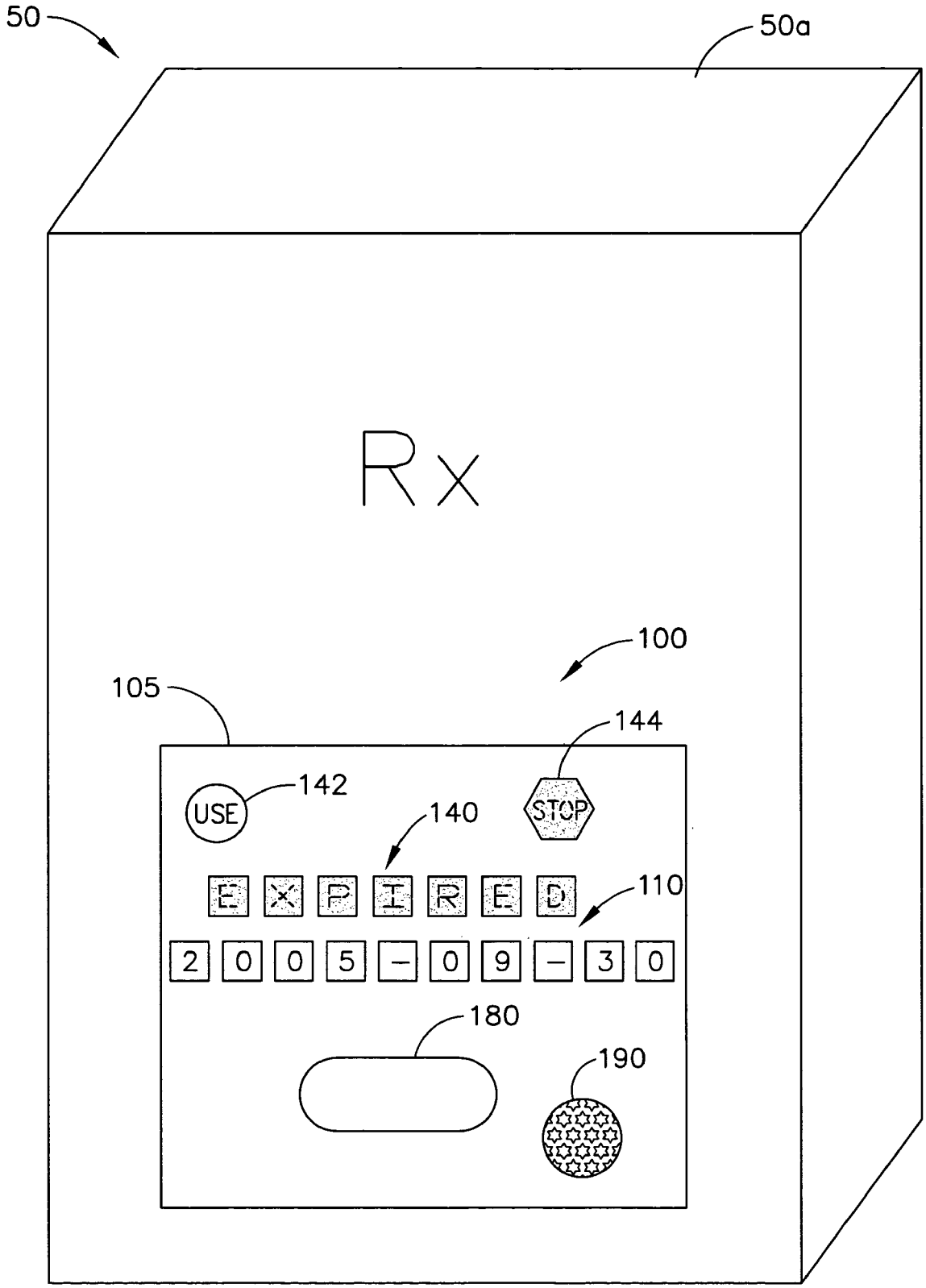
FIGS. 2A–2C illustrate the label and system and method for inventory control of FIGS. 1A–1H wherein the medical product is contained in packaging in the form of a box.
Figure 2B:
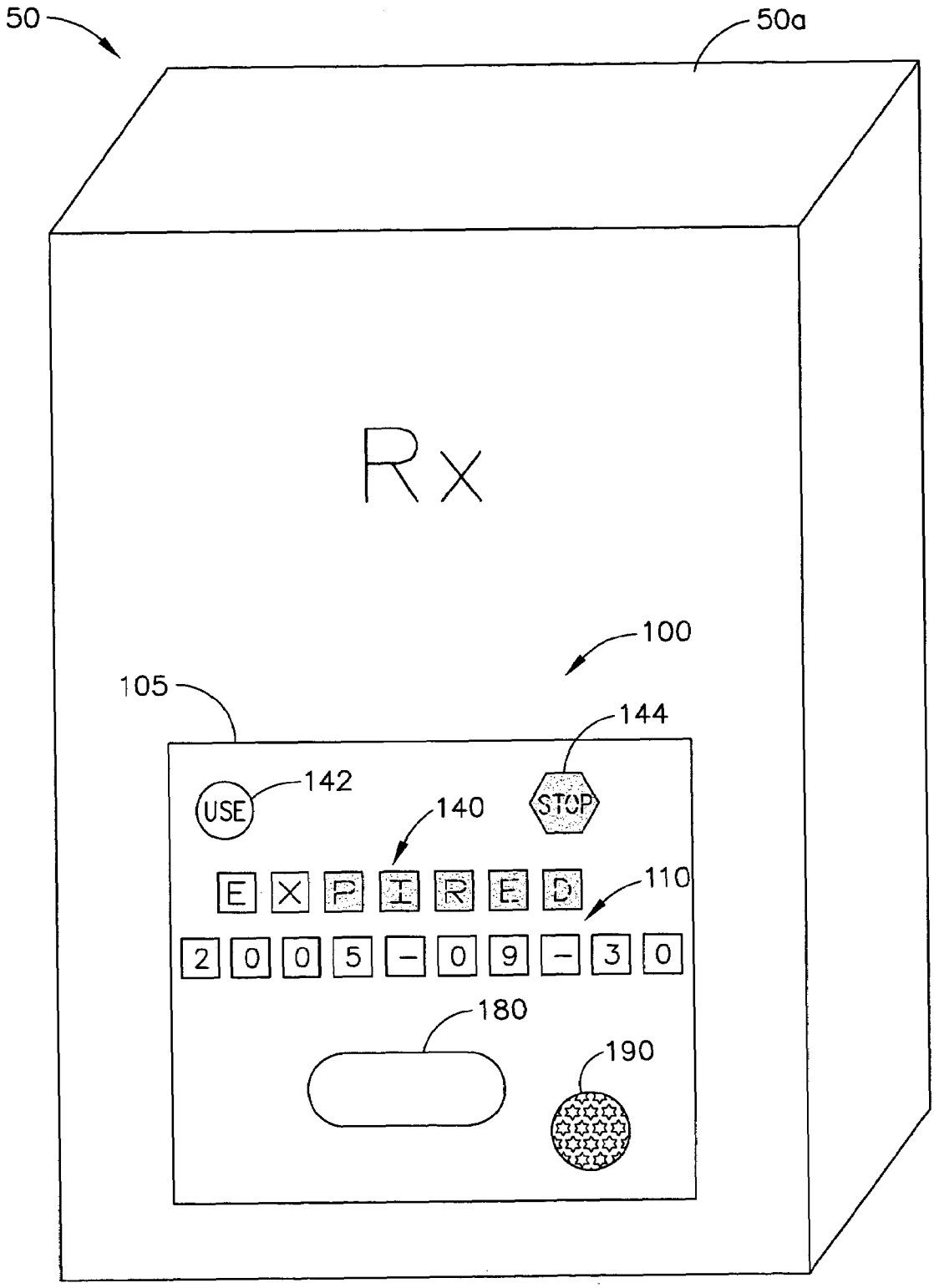
Figure 2C:
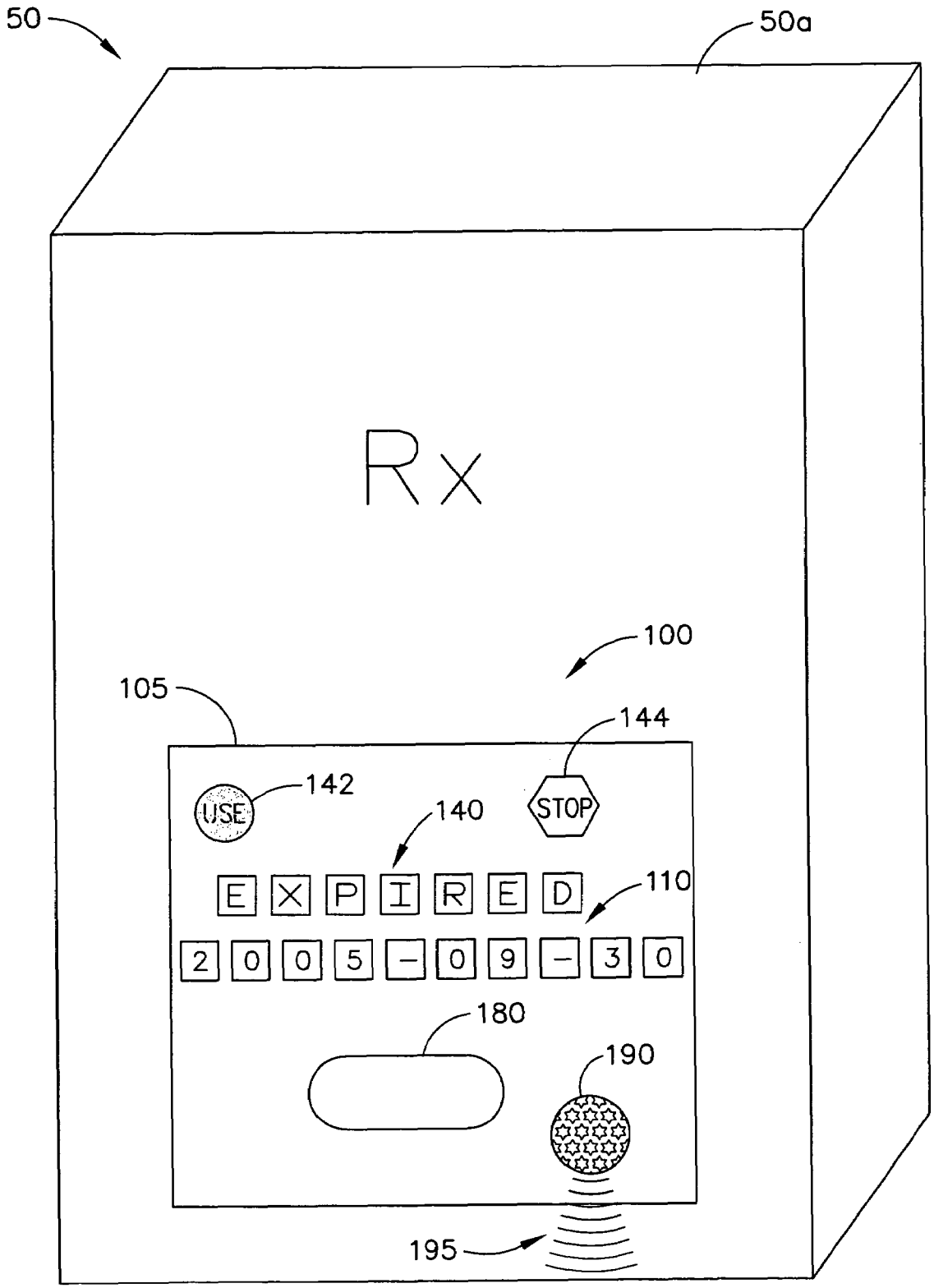
Figure 3A:
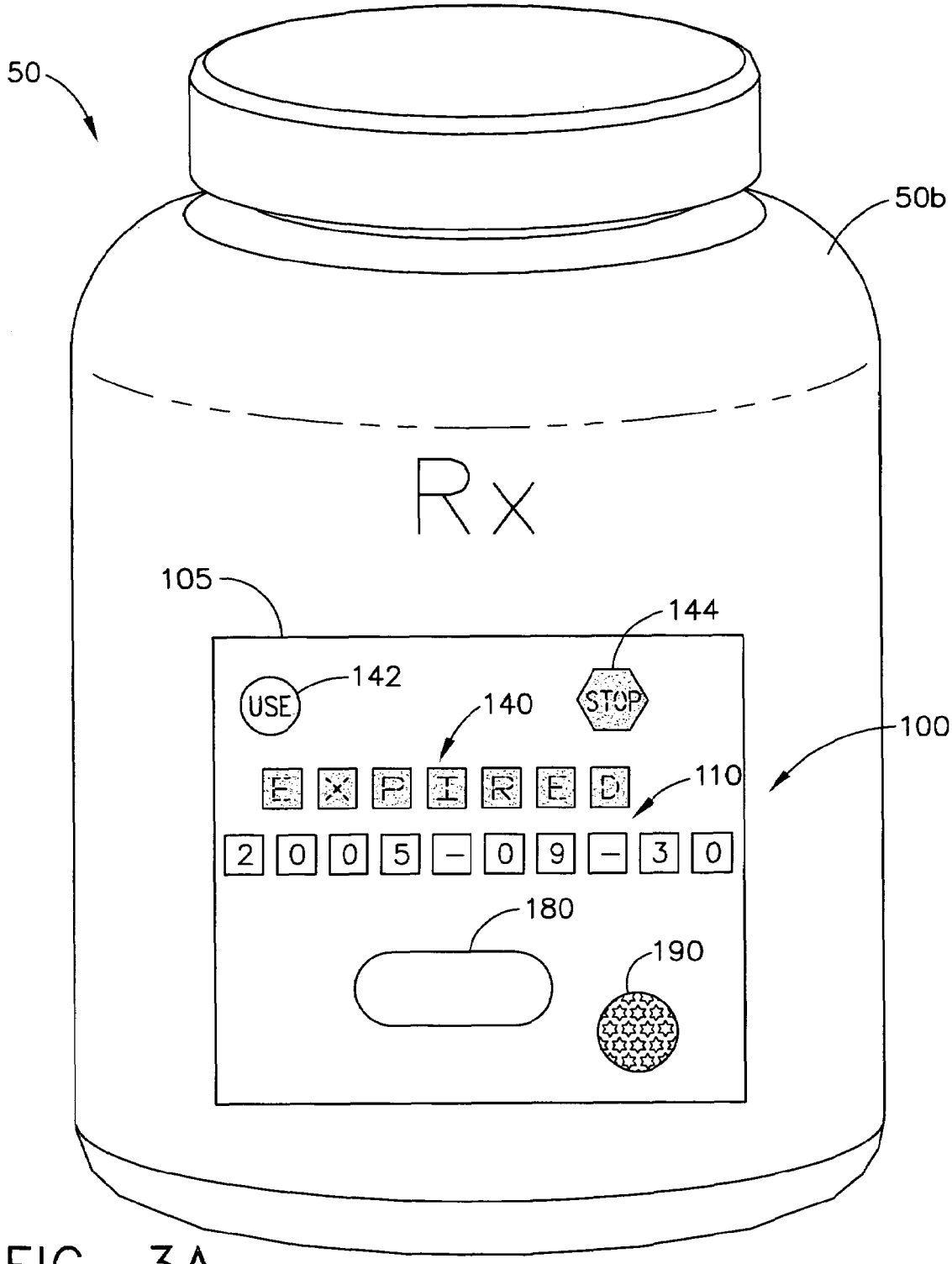
FIGS. 3A–3C illustrate the label and system and method for inventory control of FIGS. 1A–1H wherein the medical product is contained in packaging in the form of a bottle.
Figure 3B:
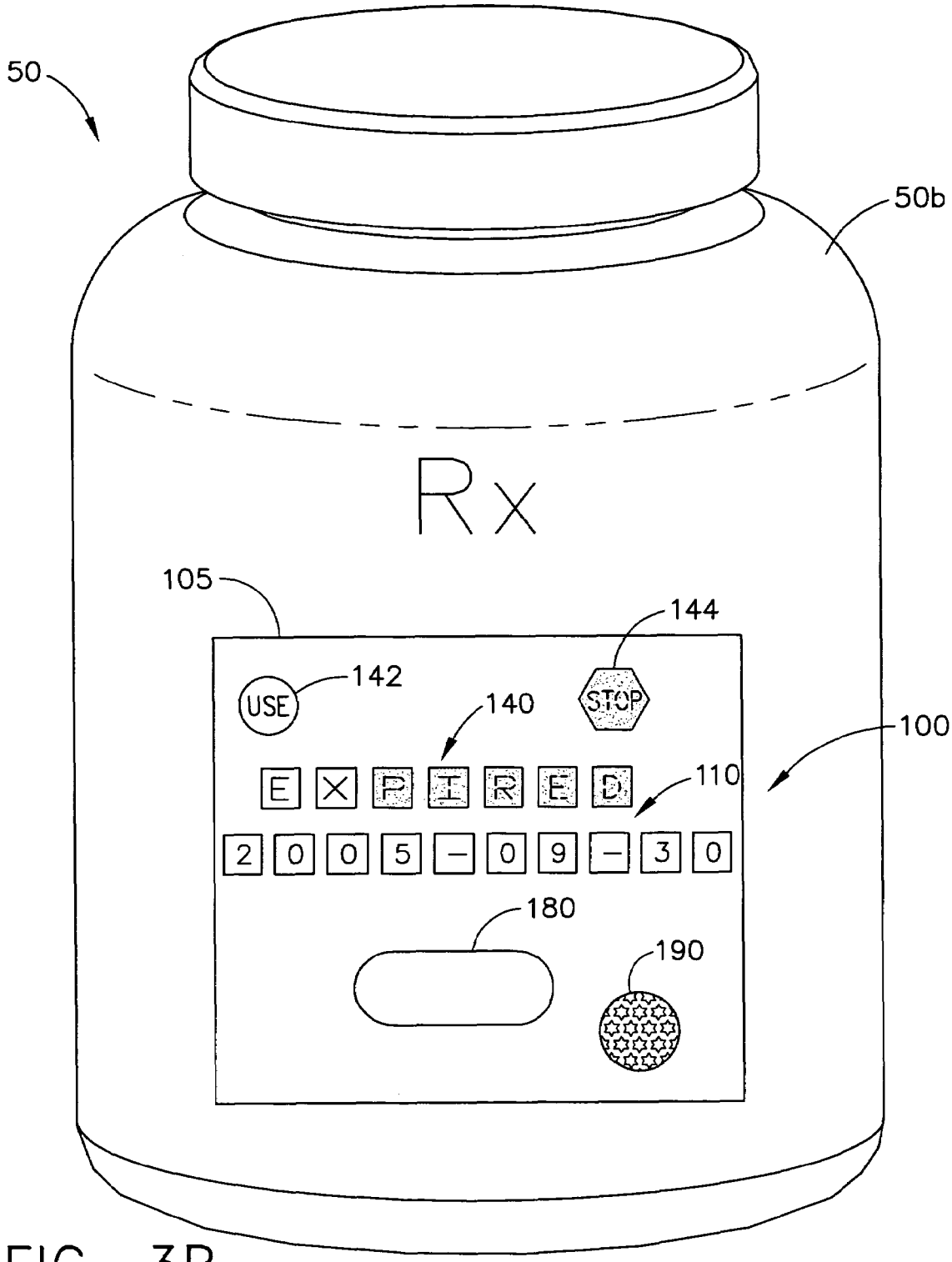
Figure 3C:
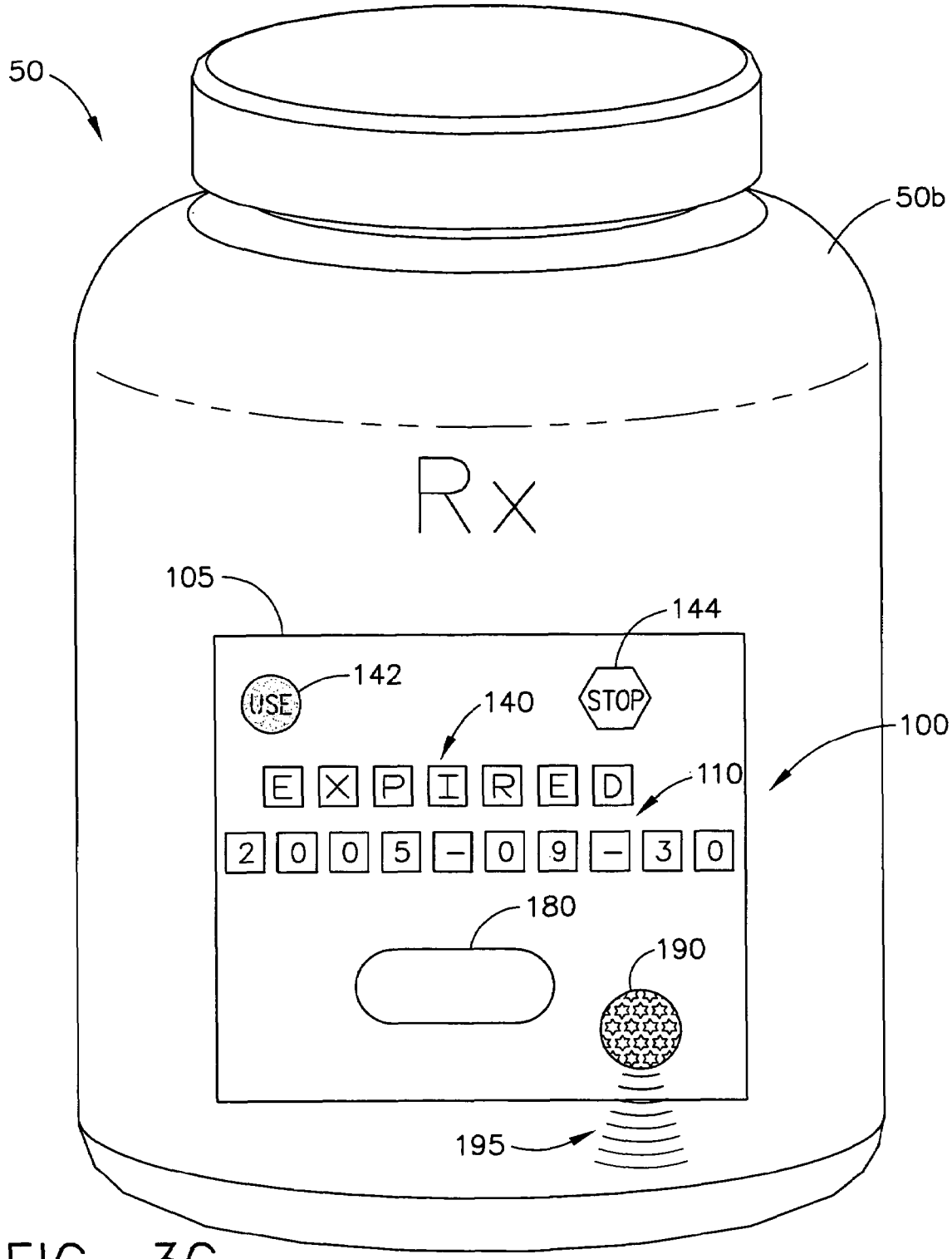

The alert device 100 (label) has a body 105 having a thickness typically in the range of 0.1 to 0.8 mm (or any desired thickness) and having any width and length dimensions capable of being affixed to the medical product itself or the medical product packaging 50 or capable of being housed or contained in the medical product packaging 50. As defined herein, the terms "medical device packaging", "packaging" or "package" can be used interchangeably and mean any type of container or storage mechanism for the medical product. Some relevant examples of "medical device packaging", "packaging" or "package" include any box, case, bottle, tray, container, pouch, bag, dish, tube, beaker, or the like to include any components associated therewith such as a top, cap, lid, stopper, flap, Tyvek, seal, fitting or the like. Some illustrative examples are shown in FIGS. 2A–2C (packaging 50 as a box 50*a*), FIGS. 3A–3C (packaging 50 as a bottle 50*b*) and FIGS. 4A–4C (multiple section packaging 50 for a drug eluting stent "DES", such as the CYPHER® Sirolimus-eluting Coronary Stent as part of a stent delivery system "SDS"; described in greater detail later below).

When used as a label 100 affixed to the medical product or the packaging 50 of the medical product, the alert device 100 also includes an appropriate attachment system such as an adhesive backing, hook and loop fasteners, etc. (not shown) for securing the label 100 to a surface of the packaging 50. The alert device 100 may be printed, applied to, or otherwise embedded in the packaging 50, i.e. the primary and/or secondary product packaging or at the packaging associated with the case or lot level.

Label 100 can be partially made from technology marketed by Power Paper Ltd. (Petah Tikva, Israel) as partially described in U.S. Pat. No. 6,676,021 B1, which is incorporated herein by reference. Label 100 is formed with at least one permanent region thereon, generally designated 110, for indicating permanent indicia such as an expiration date, period of use or the like. The permanent region 110 optionally includes a plurality of sub-regions 110*a*–110*j* in the examples where the permanent region 110 indicates an expiration date (in this example, four digits for the year, two digits for the month and two digits for the day wherein the year, month and day are separated by hyphens, i.e. 2005-09-30 indicating an expiration date of Sep. 30, 2005).

As will be described in better detail below, the permanent region 110, such as the expiry notice or date 110*a*–110*j* in this example, of label 100, is set through either programmed (hard coded) by the manufacturer to alert the end user of the expiration information associated with the medial product according to a predetermined, pre-set, non-modifiable time interval, or alternatively, the label 100 and permanent region 110, such as the expiry notice or date 110*a*–110*j* in this example, is configured by the end user to notify themselves or their personnel according to their personalized or customized choice of time interval, for instance a time interval prior to the manufacturer's recommended expiry date in order to serve as a warning period alerting the user of the upcoming expiration date.

The alert device 100 also includes at least one transformation region, generally designated 140, for displaying a warning indicator (for example, as shown, the at least one transformation region 140 can include a plurality of sub-regions indicated as 140*a*–140*g* in this example). In several embodiments of the present invention, the transformation region 140 has seven sub-regions 140*a*–140*g* for indicating time sensitive and relevant information or indicia in discrete sections such as each letter of the term "EXPIRED" or any like term indicating the end of recommended use period or product expiry including any variants of these indicia or terms to include abbreviations, etc. Micro-controller 150 can be programmed in any desired language for displaying the warning indicator in any language of choice selected by the end user (not limited to the English language, but rather, any language of a particular country, region or origin). Transformation region 140 and sub-regions 140*a*–140*g* are irreversibly transformable from a first state into a second state. The second state is clearly identifiable and readily discernable by any handler of the medical product packaging or end user as being different from the first state.

Figure 1G:
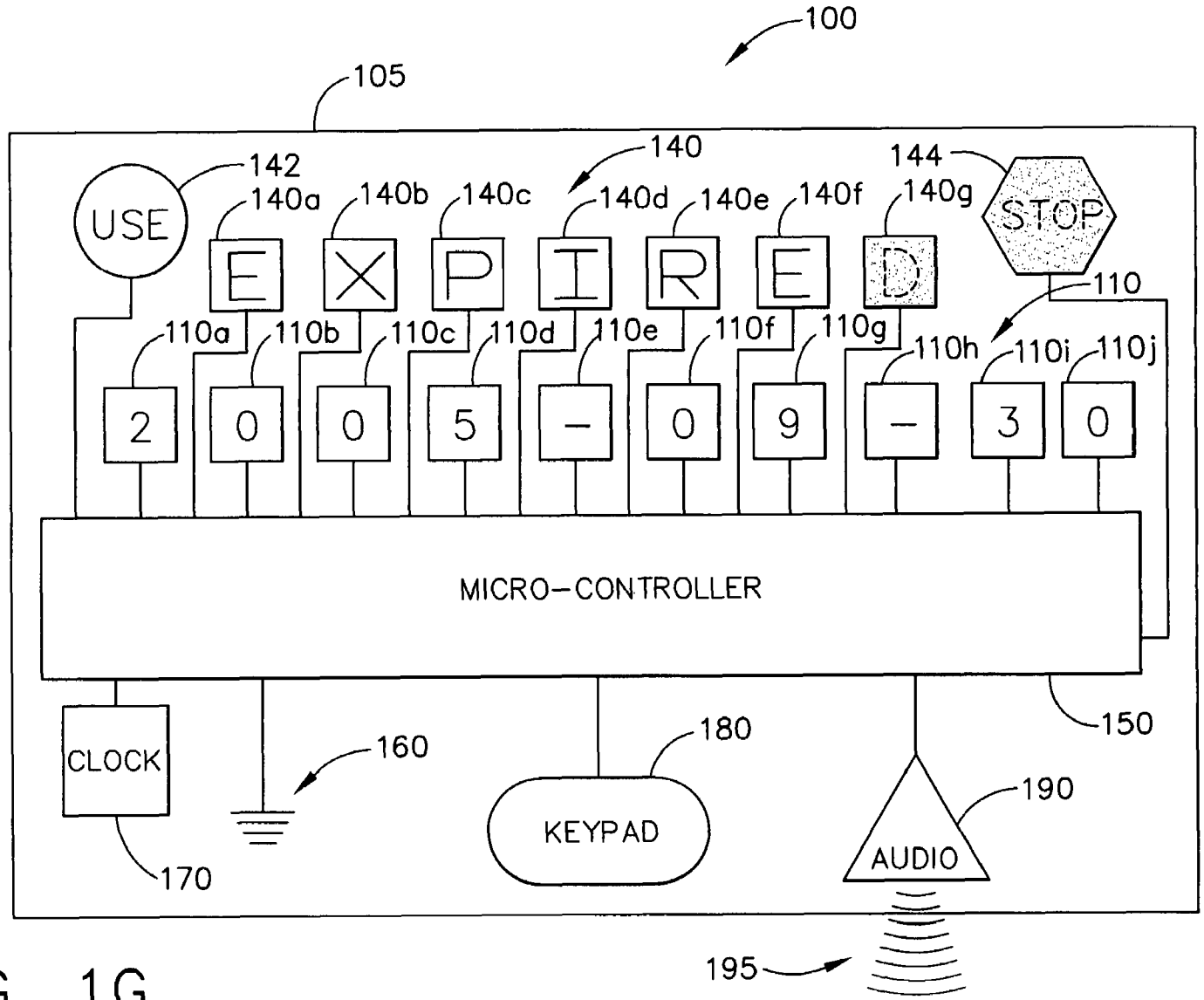
Figure 1H:
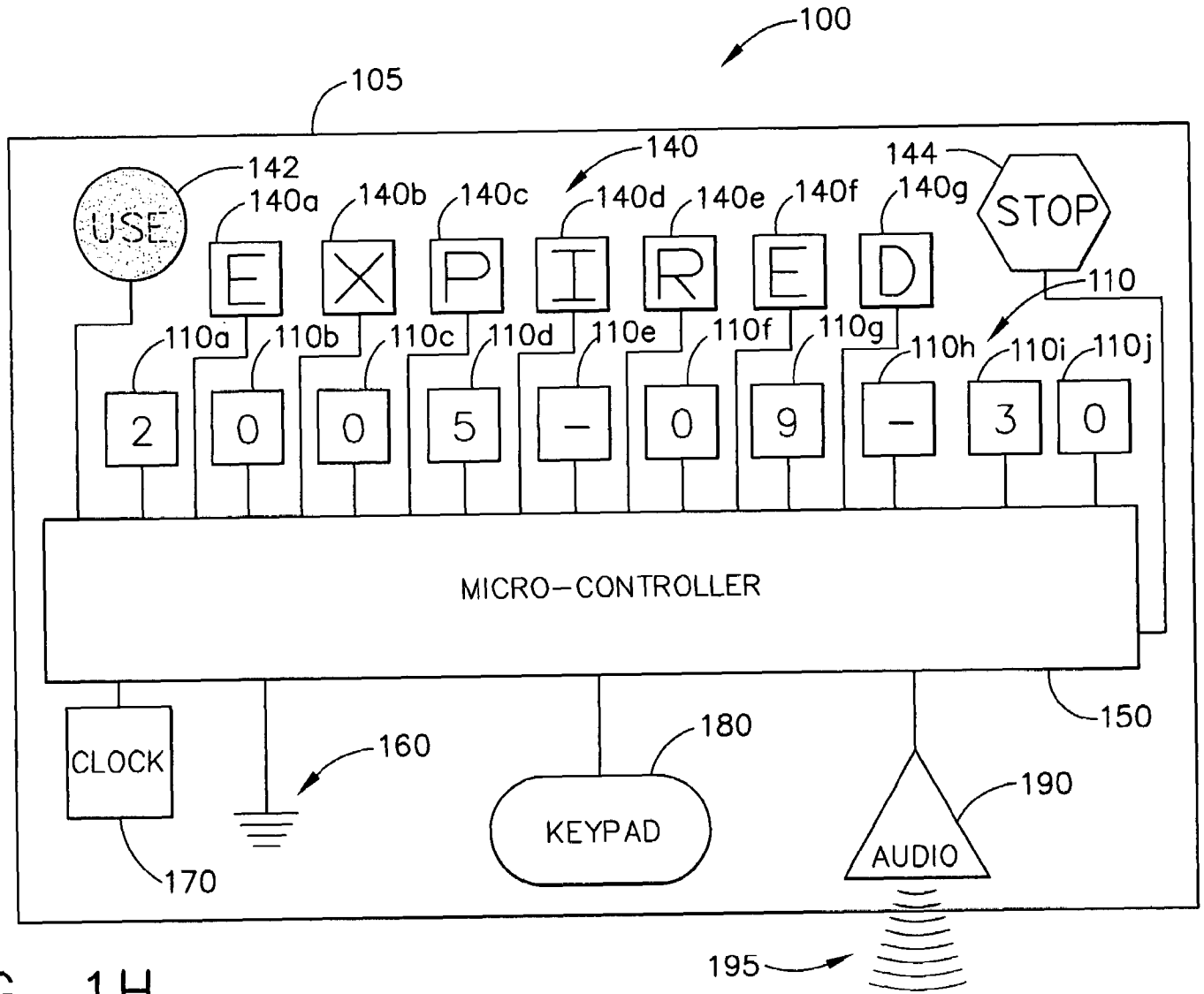

As shown in FIGS. 1A–1H, by way of example, transformation sub-regions 140*a*–140*g* contain a warning indicator according to a respective letter of the word "EXPIRED" that are not visible to the naked eye in the first state and clearly visible and readily discernable when transformed to the second state. FIG. 1A illustrates all sub-ions 140*a*–140*g* in the first state (term "EXPIRED" is not visible) while FIG. 1G illustrates all sub-regions 140*a*–140*g* in the second state wherein the term "EXPIRED" is clearly indicated.

Additionally, as a control for ensuring proper functioning for the alert device (label) 100, other transformable regions 142 and 144 respectively are optionally provided and used as reassurance and quality check of proper functioning for the alert device (label) 100. As best illustrated in FIGS. 1A–1H, transformable region 142 can be used as a positive control indicated as a symbol or message indicating proper functioning or non-expiration for the medical product, for example, a message such as "USE" and/or a green light symbol. Moreover, transformable region 144 can be used as a negative control as a symbol or message indicating improper functioning or expiration or termination of use period for the medical product, for example, a message such as "STOP" and/or a red stop sign symbol.

Likewise, similar to the functioning of transformation region 140 and sub-regions 140*a*–140*g*, transformation regions 142 and 144 respectively are also irreversibly transformable from a first state into a second state wherein the second state is clearly identifiable and readily discernable by any handler of the medical product packaging or end user as being different from the first state.

Thus, the transformation region 140, sub-regions 140*a*–140*g*, and other transformation regions 142 and 144 (control regions 142 and 144) can transform from a non-detectable region (first state) into a detectable region, e.g., colored region (second state), or from a region having one or no color (first state) into a region having another, readily distinguishable, color (second state), all as is further described and specifically exemplified hereinbelow.

The alerting device may be a visual or audible indicator such as a timer that shows decreasing intervals of time before the expiry date is reached or audible speech or other sounds that signal decreasing intervals of time before the expiry date is reached.

According to one embodiment of the present invention, each of the transformation regions 140 (including sub-regions 140*a*–140*g*), positive control region 142 and negative control region 144 include an electro-chromic substance, which may be applied in different desirable patterns, and which is capable of irreversibly changing its color as a response to an electrical potential. Such electrical potential is controlled by micro-controller 150 and can, for example, be provided, from an integrated power source 160 operatively connected to the micro-controller 150. Accordingly, the activating of the power source 160 (by micro-controller 150) to exert the electrical potential to each of the transformation regions 140*a*–140*g*, 142 and 144, results in irreversible change in color of the electro-chromic substance in each of the transformation regions 140*a*–140*g*, 142 and 144.

Examples of electro-chromic substances suitable for use with the label 100 of the present invention include, but are not limited to, Indium-Tin-Oxide and Indium-Antimony-Tin-Oxide. In one embodiment of the invention, the transformation regions 140*a*–140*g*, 142 and 144 include the electro-chromic substance and encodes unique data e.g., a code of numbers or an alphanumeric code, (in this case, the word "EXPIRED" and positive and negative controls respectively which become irreversibly visible to the packaging handler or end user when the electro-chromic substance changes its state or color as a response to the electrical potential.

Micro-controller 150 is operatively connected to the permanent region 110 (including the permanent sub-regions 110*a*–110*j*), the transformation region 140 (including transformation sub-regions 140*a*–140*g*), positive control transformation region 142 and negative control transformation region 144. The micro-controller provides a respective signal to each of the permanent region 110 (including the permanent sub-regions 110*a*–110*j*), the transformation region 140 (including transformation sub-regions 140*a*–140*g*), positive control transformation region 142 and negative control transformation region 144. The signal provided by the micro-controller 150 to the permanent region 110 (including the permanent sub-regions 110*a*–110*j*), the transformation region 140 (including transformation sub-regions 140*a*–140*g*), positive control transformation region 142 and negative control transformation region 144 can be any type of appropriate signal for activating or irreversibly changing the state of these various regions. Accordingly, the signal sent by the micro-controller is either based on an electrical signal such as current (AC or DC), electrical potential, voltage, impedance, magnetic, electromagnetic as relevant examples.

The micro-controller 150 comprises a logic circuit which can be based on any type of appropriate logic software or ASIC for controlling the permanent region 110 (including the permanent sub-regions 110*a*–110*j*), the transformation region 140 (including transformation sub-regions 140*a*–140*g*), positive control transformation region 142 and negative control transformation region 144.

Additionally, a keypad 180 is operatively connect to and associated with the micro-controller 150 for performing relevant programming of the data necessary for the permanent region 110 (including the permanent sub-regions 110*a*–110*j*), i.e. the expiration date as eight characters separated by hyphens, the transformation region 140 (including transformation sub-regions 140*a*–140*g*), i.e. the term "EXPIRED", the positive control transformation region 142, i.e. green light symbol and term "USE" and negative control transformation region 144, i.e. red stop sign symbol and term "STOP". Accordingly, in these embodiments according to the present invention, the manufacturer or the end user has the ability to program the expiration date into permanent region 110 (including the permanent sub-regions 110*a*–110*j*) using the keypad 180. It may be desirable for the manufacturer to permanently set the expiration date in a permanently locked (tamper proof) state in permanent region 110 at the manufacturing site thereby eliminating any possibility of tampering or adjusting of the expiration date by another person.

Additionally, an optional clock 170 (which can be a digital clock) is operatively connected to micro-controller 150 for purposes such as setting or configuring the indicia in permanent region 110, i.e. the eight digit expiration date (not including hyphens for sub-regions 110*a*–110*j*), and for outputting continuous time readings in real time for the monitoring the elapsing time period (through micro-controller 150) for transformation regions 140 including 140*a*–140*g*, and control regions 142 and 144 respectively. Accordingly, micro-controller 150 continuously monitors the real time output from digital clock 170 through continuous readings and activates irreversible regions 140 (including sub-regions 140*a*–140*g*), and irreversible control regions 142 and 144 respectively at the designated pre-determined times. Power source 160 also provides power to digital clock 170 through micro-controller 150.

An audio output device 190 for outputting an audible signal 195 such as an alarm which can be in the form of any desired tone or tones or audible warning statements in any desired language which can all be programmed into the logic circuit or software of micro-controller 150, for example, when the last sub-region 140*g* has been achieved and all sub-regions 140*a*–140*g* has been filled, meaning the term "EXPIRED" is reflected in these sub-regions based on the lapse of the pre-determined, set expiration period. The audio signal is provided at any time(s) prior to the expiration date for the medical product and/or on the expiration date for the medical product, i.e. in advance of the expiration date and/or at any desired times during the warning period, and/or on the expiration date for the medical product.

The warning system of the present invention is both visual and audible (if desired). Visual warning is provided through irreversible region 140 and sub-regions 140*a*–140*g* of the alert device 100. These sub-regions 140*a*–140*g* may be a visual indicator such as a timer that shows decreasing intervals of time before the expiry date is reached. Moreover, alarm 190 provides warning 195 in the form of an audible signal or audible speech or other sounds that signal decreasing intervals of time before the expiry date is reached.

Figure 4A:
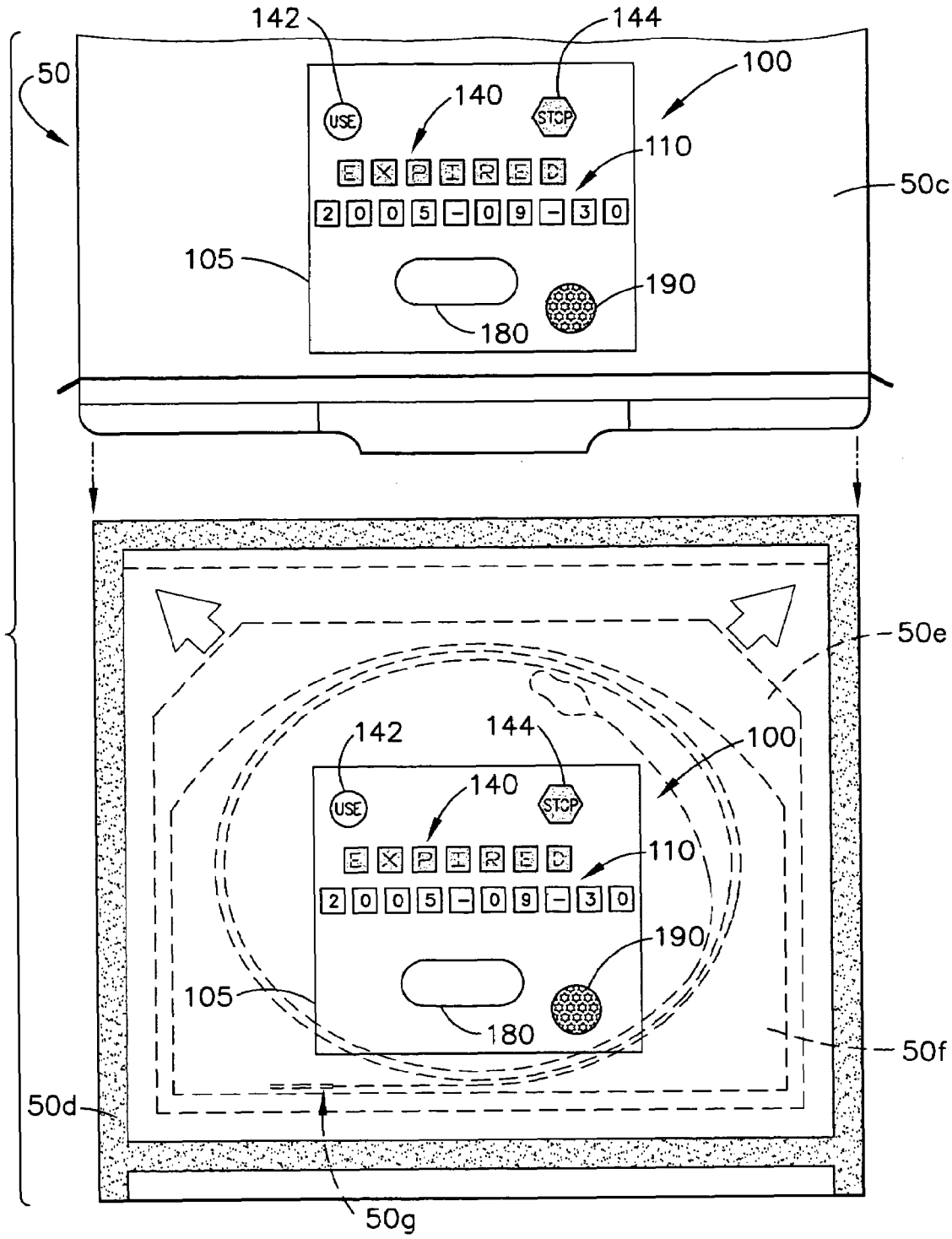
FIGS. 4A–4C illustrate the label and system and method for inventory control of FIGS. 1A–1H wherein the medical product is contained in multiple section packaging for a drug eluting stent as part of a stent delivery system.
Figure 4B:
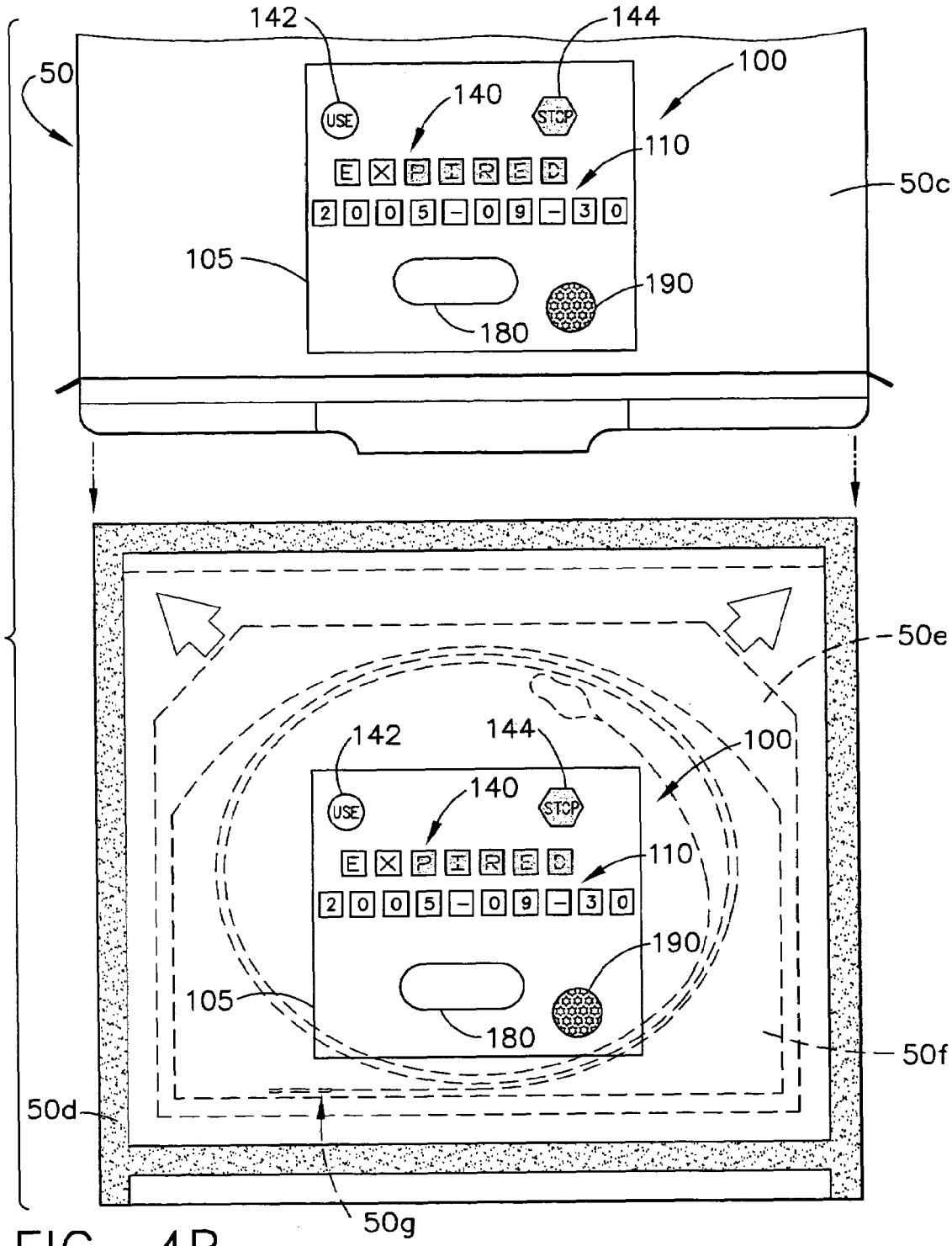
Figure 4C:
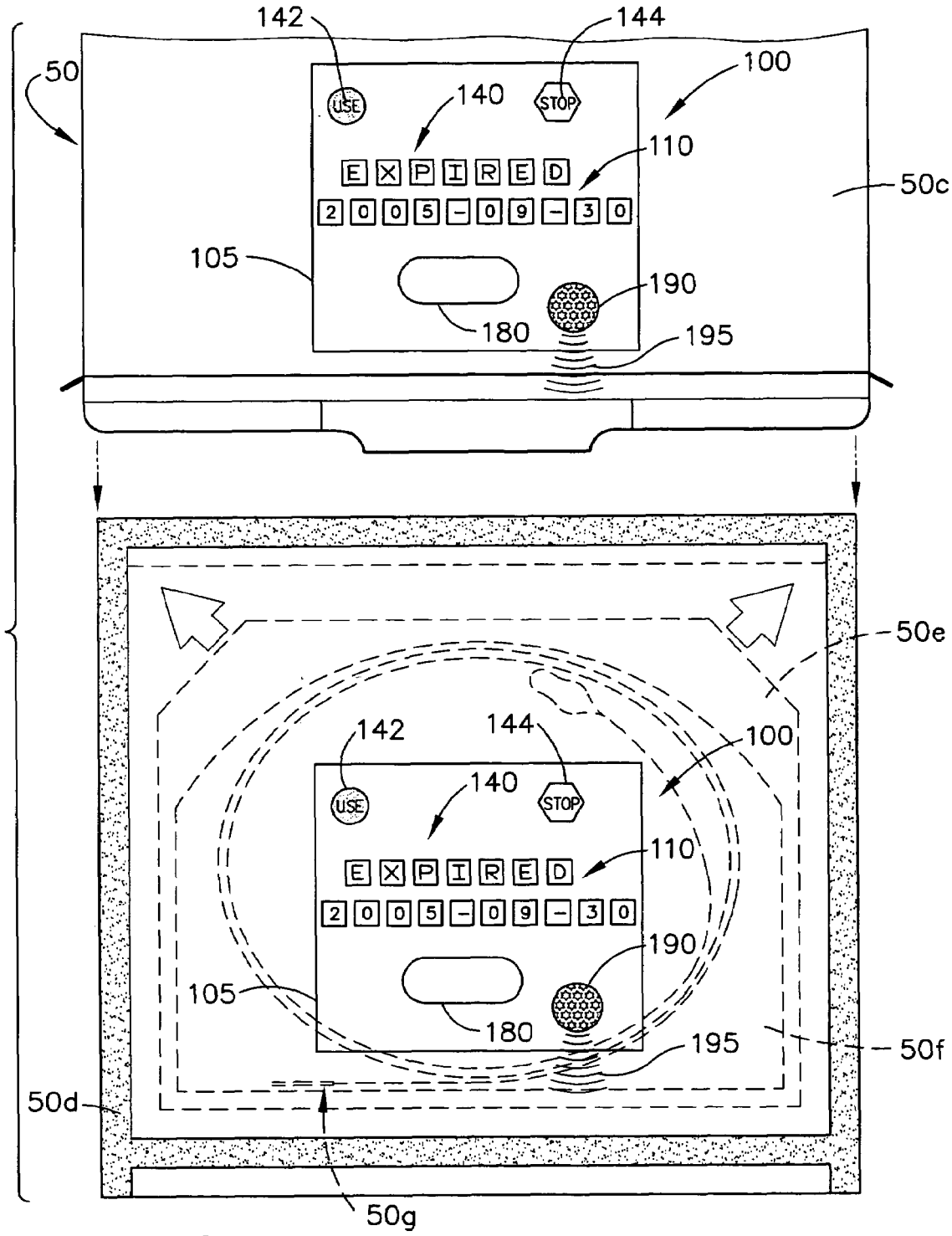

One appropriate example for use of the alert device 100 in accordance with present invention is a drug eluting stent (DES), such as the CYPHER® Sirolimus-eluting Coronary Stent as part of a stent delivery system (SDS), generally designated 50*g*, in its multiple section packaging 50 as best shown in FIGS. 4A–4C. In this example, the medical product (CYPHER® Sirolimus-eluting Coronary Stent) 50*g* has an FDA mandated expiration date period, for instance, 90 days from date of manufacture. Accordingly, alert device 100 is associated with (affixed to or adhered to) all key sections of the multiple section packaging 50 in accordance with this example. For instance, alert device 100 is affixed to the box 50*c* as shown. Box 50*c* contains sterile packaging and maintains a sterile environment by using an outer pouch (outer foil pouch) 50*d* with a tearable section (indicated by dashed horizontal lines across the top portion of outer pouch 50*d*. The outer pouch 50*d* also includes a second alert device 100 affixed on a surface thereof. An inner pouch 50*e* is removable housed or contained within outer pouch 50*d*. Inner pouch 50*e* is also a sealed pouch maintaining a sterile environment for tray 50*f* and medical product 50*g* (DES and SDS in this example) which is protected and held in place by tray 50*f*. The inner pouch 50*e* also includes a third alert device 100 affixed on a surface thereof (not shown—hidden behind second alert device 100 on outer pouch 50*d*). Thus, in this example, three separate alert devices 100 are used on each key section of the multiple section packaging 50 associated with this particular product 50*g*. Each of the alert devices 100 are programmed with the same expiration date 110 through use of the micro-controller 150 associated with each alert device 100 in the manner described previously above.

Furthermore, the present invention is also a method for controlling inventory of medical product 50*g*. The inventory of medical product 50*g* is controlled according its expiration date through permanent region 110 and irreversible transformable region 140 and its sub-regions 140*a*–140*g*. In this example, the irreversible region 140 and its sub-regions 140*a*–140*g* serve as a visual indicator that counts down the remaining week (7 day period) before expiration by forming the word "expired" through a thin, digital display or through the appearance of letters via a chemical (e.g. oxidative) process is as follows:

E (7 days before expiry)
EX (6 days before expiry)
EXP (5 days before expiry)
EXPI (4 days before expiry)
EXPIR (3 days before expiry)
EXPIRE (2 days before expiry)
EXPIRED (Day of expiry)

Accordingly, the alert device 100 uses an algorithm that is contained in the micro-controller 150 as follows:

$$\text{Time}_{exp}-\text{Warning Period}_{total}=\text{Time}_{warn\ start}$$

In this example, $\text{Time}_{exp}$ (Sep. 30, 2005)−Warning $\text{Period}_{total}$ (7 days total to expiry)=$\text{Time}_{warn\ start}$ (Sep. 24, 2005).

Upon final manufacturing of the medical product 50*g*, the expiration date (reflected in permanent region 110) is keyed into the software program and algorithm of micro-controller 150 through use of the keypad 180. Accordingly, the manufacturer programs this expiration date into the software of the micro-controller such that the expiration date is visually indicated on the label 100 of the packaging. When multiple section packaging is used that require separate labels 100 for each key section of the packaging 50 (such as shown in FIGS. 4A–4C), the same expiration date is programmed into the micro-controller 150 for each label 100.

Additionally, alert device or label 100 commences a series of consecutive visual indicators by using irreversible sub-regions 140*a*–140*g* on consecutive days according to a formula (contained in the micro-controller 150) wherein each irreversible sub-regions 140*a*–140*g* indicates the appropriate warning based on the number of days prior Expiry date. Thus, a separate sub-region 140*a*–140*g* is visible for each day prior to Expiry date beginning on the date the warning visual should start, i.e. $\text{Time}_{warn\ start}$ (Sep. 24, 2005 in the example shown) with a visual indicator shown in sub-region 140*a*. Each subsequent day, will cause another sub-region 140*b*, 140*c*, etc. to show its appropriate visual indicator on that designated day prior to Expiry date.

Accordingly, in this example, on Sep. 24, 2005, irreversible sub-region 140*a* will indicate "E" seven days prior to Expiry; irreversible sub-region 140*b* will indicate "EX" six days prior to Expiry; irreversible sub-region 140*c* will indicate "EXP" five days prior to Expiry; irreversible sub-region 140*d* will indicate "EXPI" four days prior to Expiry; irreversible sub-region 140*e* will indicate "EXPIR" three days prior to Expiry; irreversible sub-region 140*f* will indicate "EXPIRE" two days prior to Expiry; and irreversible sub-region 140*g* will indicate "EXPIRED" on the day of Expiry.

Additionally, the audio alarm 190 (optional) sounds an audio signal or audio expiration message 195 which can be either a specific audible tone, audible pulse tone (such as series of beeps) or audible verbal message or statement (in any desired language programmed into the micro-controller 150) that medical product (in this example DES 50*g*) has reached its expiration date.

In general, handlers and end users, for example surgical nurses and physicians, of this type of medical product, i.e. stent products or DES products, are commonly known to select their stent products or DES products, from their storage rooms and inventory shelving without referring to expiration dates marked or indicated on the packaging. Accordingly, stent products or DES products or other types of medical products that actually have longer remaining expiration periods are selected for use first, whereas those medical products that are closer to expiration are often not chosen or selected due to simple oversight by the product handlers and end users. Accordingly, the alert device or label 100 in accordance with the present invention avoids this problem and ensures that the inventory of medical product is properly managed, i.e. by ensuring each product visibly reflects remaining days prior to expiration through the EXPIRED nomenclature and methodology outlined above. Thus, when using the alert device or label 100 as part of an overall inventory management system, the product handler or end user selects only those medical products that have the earliest expiration date reflected through visual indicators shown in irreversible sub-regions 140*a*–140*g*. In this example, DES product 50*g*, can be managed by visually identifying those products closest to their expiration date (reflected in permanent region 110) and reinforced and visually alerted as a visual indicator by identifying how many of the irreversible sub-regions 140*a*–140*g* have reversed their color or visual scheme.

Accordingly, the product handler or end user will first identify only that medical product 50*g* which has one or more irreversible sub-regions 140*a*–140*g* that have undergone color or visual scheme change. In order of priority, the handler or end user will select medical product 50*g* according to the following prioritized scheme:

EXPIRED (Day of expiry)
EXPIRE (2 days before expiry)
EXPIR (3 days before expiry)
EXPI (4 days before expiry)
EXP (5 days before expiry)
EX (6 days before expiry)
E (7 days before expiry)

In the event none of the medical product 50*g* in inventory does not have any irreversible sub-regions 140*a*–140*g* with a color change, i.e. $\text{Time}_{warn\ start}$ has not yet been initiated due to the present date or date of use of the medical product 50*g* being more than 7 days prior to its expiry date, the handler or end user will draw medical product 50*g* from inventory for use based on the earliest expiry date reflected in permanent region 110.

According to another embodiment of the present invention permanent region 110 (including the permanent sub-regions 110*a*–110*j*), the transformation region 140 (including transformation sub-regions 140*a*–140*g*), positive control transformation region 142 and negative control transformation region 144 include a heatable element which is capable of irreversibly changing an appearance of each of these regions when heated, by for example, inflicting burn marks thereon. The heatable element contained within permanent region 110 (including the permanent sub-regions 110*a*–110*j*), the transformation region 140 (including transformation sub-regions 140*a*–140*g*), positive control transformation region 142 and negative control transformation region 144 can be, for example, a heatable resistor (heating wire), a heatable conductor or a heatable semiconductor, e.g., semiconductor junction. Again, micro-controller 150 controls activation of the heatable element in each of the regions through the integrated power source 160 such that activating power source 160 to heat the heatable element results in irreversible change in appearance of permanent region 110 (including the permanent sub-regions 110*a*–110*j*), the transformation region 140 (including transformation sub-regions 140*a*–140*g*), positive control transformation region 142 and negative control transformation region 144. Similar to the above-outlined embodiment, according to a preferred configuration, the heatable element encodes the unique data which becomes irreversibly visible to the packaging handler or end user when heatable element is activated or heated upon command of micro-controller 150.

According to a preferred embodiment of the present invention the integrated power source 160 includes a capacitor which can be discharged, thereby providing high voltage which is required for implementing some of the embodiments of the present invention as herein described. Such a capacitor can be charged by an integrated battery (electrochemical cell) or in other cases, by an inducible power source, such as, but not limited to, a radiofrequency responsive coil or a piezoelectric component which is mechanically inducible. Direct power supply can also be effected by any of the above power sources, as well as AC power, when combined with a DC to AC converter.

A highly suitable power source for use with the alert device 100 of the present invention includes a flexible thin layer open liquid state electrochemical cell. The structure, manufacture and integration into electronic applications of such a flexible thin layer open liquid state electrochemical cell are described in detail in U.S. Pat. Nos. 5,652,043; 5,811,204 and 5,897,522, all to Nitzan, which are incorporated by reference as if fully set forth herein.

Briefly, the cell described in these U.S. Patents is an open liquid state electrochemical cell which can be used as a primary or rechargeable power supply for various miniaturized and portable electrically powered devices of compact design. The cell comprises a first layer of insoluble negative pole, a second layer of insoluble positive pole and a third layer of aqueous electrolyte, the third layer being disposed between the first and second layers and including (a) a deliquescent material for keeping the open cell wet at all times; (b) an electroactive soluble material for obtaining required ionic conductivity; and, (c) a water soluble polymer for obtaining a required viscosity for adhering the first and second layers to the first layer. Several preferred embodiments of the battery disclosed in U.S. Pat. No. 5,652,043 include (i) engaging the electrolyte layer in a porous substance, such as, but not limited to, a filter paper, a plastic membrane, a cellulose membrane and a cloth; (ii) having the first layer of insoluble positive pole include manganese-dioxide powder and the second layer of insoluble negative pole include zinc powder; (iii) having the first layer of insoluble negative pole and/or the second layer of insoluble positive pole further include carbon powder; (iv) selecting the electroactive soluble from zinc-chloride, zinc-bromide, zinc-fluoride and potassium-hydroxide; (v) having the first layer of insoluble negative pole include silver-oxide powder and the second layer of insoluble positive pole include zinc powder and the electroactive soluble material is potassium-hydroxide; (vi) having the first layer of insoluble negative pole include cadmium powder and the second layer of insoluble positive pole include nickel-oxide powder and selecting the electroactive soluble material to be potassium-hydroxide; (vii) having the first layer of insoluble negative pole include iron powder and the second layer of insoluble positive pole include nickel-oxide powder and selecting the electroactive soluble material to be potassium-hydroxide; (viii) having the first layer of insoluble negative pole and the second layer of insoluble positive pole include lead-oxide powder, the cell is charged by voltage applied to the poles and the electroactive soluble material is selected in this case to be sulfuric-acid; (ix) the deliquescent material and the electroactive soluble material can be the same material such as zinc-chloride, zinc-bromide, zinc-fluoride and potassium-hydroxide; (x) the deliquescent material is selected from the group consisting of calcium-chloride, calcium-bromide, potassiumbiphosphate and potassium-acetate; (xi) the water soluble polymer can be polyvinylalcohol, poliacrylamide, polyacrylic acid, polyvinylpyrolidone, polyethylenoxide, agar, agarose, starch, hydroxyethylcellulose and combinations and copolymers thereof; (xii) the water soluble polymer and the deliquescent material can be the same material such as dextrane, dextranesulfate and combinations and copolymers thereof. The cell described in these U.S. patents preferably includes terminals, each of the terminals being in electrical contact with one of the first and second pole layers. Such terminals can be made, for example, of graphite or a metal, such as iron, nickel, titanium, copper, stainless steel and mixtures thereof. The terminals can be applied to the cell and the entire cell can be manufactured by a suitable printing technology such as, but not limited to, silk print, offset print, jet printing, lamination, materials evaporation or powder dispersion. At least one carbon or graphite based conductive layer can be employed with the cell for improving the electronic conductivity of at least one of the first and second pole layers. Preferred configurations for power source 160 of the alert device 100 according to the present invention involve those combinations which are devoid of poisonous compounds.

According to another embodiment of the present invention irreversible region 140 and sub-regions 140*a*–140*g* include a photo-chromic substance which is capable of irreversibly changing its color as a response to lighting in a predefined wavelength, e.g., the visible range and/or ultraviolet radiation. Examples of photo-chromic substances suitable for use with alert device 100 of the present invention include Oxazine and Naphthopyran. Suitable radiation sources for activating the photo-chromic substance include sunlight, an ultraviolet light source, and any other artificial light source in a suitable wavelength range. The photo-chromic substance preferably encodes unique data on the alert device 100 (label) which becomes irreversibly visible to the medical product handler or end user when the photo-chromic substance changes its color as a response to lighting. A removable light impermeable cover can be used to protect the alert device 100 from light exposure prior to use.

According to another embodiment of the present invention irreversible region 140 and irreversible sub-regions 140*a*–140*g* of alert device 100 include a thermo-chromic substance which is capable of irreversibly changing its color as a response to external heating. Examples of thermo-chromic substances suitable for use with the label 100 of the present invention include $M_2$ $HgI_4$, where M is Ag(I) or Cu(I). Suitable radiation sources for activating the thermo-chromic substance include sunlight, an infrared light source, and any other heat source. The thermo-chromic substance preferably encodes unique data which becomes irreversibly visible to medical product handler or end user when the electro-chromic substance changes its color as a response to external heating.

Additionally, any relevant electro-chromic, thermo-chromic and photo-chromic substances can be used with the present invention. The use of such substances and of heatable elements which may inflict burns according to the present invention provides the alert device 100 of the present invention with a highly effective means for providing visual warning of product expiration and method for inventory control.

The label 100 together with any time sensitive medical product and the packaging 50 therefor comprise a useful system for monitoring shelf life and elapsed time prior to expiration of the medical product and alerting the end user of an upcoming expiration according to a warning period in advance of the expiration date and/or at any desired times during the warning period, and/or on the expiration date for the medical product.

The alert device 100 and system and method for managing inventory for medical product is particularly cost effective especially given the high cost of goods usually associated with products such as medical devices and prescription medications, over the counter non-prescription consumer goods and packaged foods.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

Inasmuch as the foregoing specification comprises preferred embodiments of the invention, it is understood that variations and modifications may be made herein, in accordance with the inventive principles disclosed, without departing from the scope of the invention.

While preferred embodiments of the present invention have been shown and described herein, it will be obvious to those skilled in the art that such embodiments are provided by way of example only. Numerous variations, changes and substitutions will now occur to those skilled in the art without departing from the invention. Accordingly, it is intended that the invention be limited only by the spirit and scope of the appended claims.

What is claimed is:

1. A system for monitoring a time sensitive medical product, the system comprising:

a medical product;

a packaging containing the medical product;

at least one label associated with the packaging or the medical product, the at least one label comprising:

(i) at least one permanent region having permanent indicia;

(ii) at least one transformable region having time sensitive indicia, the time sensitive indicia being non-detectable in a first state and detectable in a second state;

(iii) a micro-controller operatively connected to at least one of the at least one permanent region and the at least one transformable region, the micro-controller monitoring elapsed time and causing the at least one transformable region to change from the first state to the second state thereby revealing the time sensitive indicia in the second state; and (iv) a power source operatively connected to the micro-controller.

2. The system according to claim 1, wherein the at least one transformable region is irreversibly transformable.

3. The system according to claim 2, further comprising a clock operatively connected to the micro-controller.

4. The system according to claim 3, further comprising a keypad operatively connected to the micro-controller for inputting data.

5. The system according to claim 4, wherein the data relates to an expiration date for the medical product.

6. The system according to claim 5, wherein the expiration date is displayed in the at least one permanent region.

7. The system according to claim 6, further comprising an audio output device operatively connected to the micro-controller, the audio output device outputting an audio signal when the at least one transformable region changes from the first state to the second state.

8. The system according to claim 7, further comprising a second transformable region operatively connected to the micro-controller, the second transformable region being used as a positive control relating to use of the medical product.

9. The system according to claim 8, further comprising a third transformable region operatively connected to the micro-controller, the third transformable region being used as a negative control relating to use of the medical product.

10. The system according to claim 9, wherein the second transformable region and the third transformable region display indicia.

11. The system according to claim 10, wherein the indicia for at least one of the second transformable region and the third transformable region includes a symbol.

12. The system according to claim 11, wherein the indicia for at least one of the second transformable region and the third transformable region includes a color.

13. The system according to claim 12, wherein the at least one transformable region, the second transformable region and the third transformable region comprise an electrochromic material.

14. The system according to claim 13, wherein the at least one transformable region, the second transformable region and the third transformable region comprise a photo-chromic material.

15. The system according to claim 14, wherein the at least one transformable region, the second transformable region and the third transformable region comprise a thermochromic material.

16. The system according to claim 15, wherein the medical product is a drug.

17. The system according to claim 15, wherein the medical product is a device.

18. The system according to claim 15, wherein the medical product is a drug eluting stent.

19. The system according to claim 18, wherein the medical product further includes a stent delivery system.

20. The system according to claim 19, wherein the packaging comprises a box.

21. The system according to claim 20, wherein the packaging further comprises an outer pouch.

22. The system according to claim 21, wherein the packaging further comprises an inner pouch.

23. The system according to claim 22, wherein the packaging further comprises a tray.

24. The system according to claim 21, further including a second label with the outer pouch.

25. The system according to claim 24, further including a third label with the inner pouch.

26. The system according to claim 15, wherein the packaging comprises a bottle.

27. The system according to claim 15, wherein the packaging comprises a box.

28. The system according to claim 15, wherein the packaging comprises a pouch.

* * * * *